US006967229B2

(12) United States Patent
Voorheis

(10) Patent No.: US 6,967,229 B2
(45) Date of Patent: Nov. 22, 2005

(54) CARBON-CARBON INITIATORS FOR USE IN GOLF BALLS

(75) Inventor: Peter R. Voorheis, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 191 days.

(21) Appl. No.: 10/614,325

(22) Filed: Jul. 7, 2003

(65) Prior Publication Data

US 2005/0009992 A1 Jan. 13, 2005

(51) Int. Cl.[7] ..... A63B 37/06; C08L 51/04

(52) U.S. Cl. ..... 525/264; 525/244; 525/261; 525/274; 473/371; 473/374; 473/377; 473/378

(58) Field of Search ..... 525/244, 261, 525/264, 274; 473/371, 374, 377, 378

(56) References Cited

U.S. PATENT DOCUMENTS

| | | | | | |
|---|---|---|---|---|---|
| 3,572,721 | A | * | 3/1971 | Harrison et al. | 473/373 |
| 4,027,080 | A | | 5/1977 | Amtmann et al. | 526/12 |
| 4,117,017 | A | | 9/1978 | Morgan et al. | 260/609 R |
| 4,135,047 | A | | 1/1979 | Morgan | 544/219 |
| 4,556,695 | A | | 12/1985 | Ijntema | 525/359.6 |
| 4,948,820 | A | | 8/1990 | Addeo et al. | 523/124 |
| 5,118,763 | A | * | 6/1992 | Aoki et al. | 525/332.8 |
| 6,057,403 | A | * | 5/2000 | Sullivan et al. | 525/221 |
| 6,267,692 | B1 | * | 7/2001 | Higuchi et al. | 473/365 |
| 2002/0006837 | A1 | * | 1/2002 | Dalton et al. | 473/361 |
| 2003/0045378 | A1 | | 3/2003 | Bissonnette et al. | 473/378 |
| 2003/0064826 | A1 | | 4/2003 | Voorheis et al. | 473/367 |
| 2003/0114255 | A1 | | 6/2003 | Dalton et al. | 473/384 |

* cited by examiner

*Primary Examiner*—David J. Buttner

(57) ABSTRACT

A golf ball comprising a core and a cover, wherein at least the core or the cover comprises an elastomeric composition comprising a base polymer and a carbon-carbon initiator.

33 Claims, No Drawings

CARBON-CARBON INITIATORS FOR USE IN GOLF BALLS

FIELD OF THE INVENTION

The present invention generally relates to golf balls and, more specifically, to elastomeric compositions for golf ball cores that comprises a carbon-carbon free radical initiator.

BACKGROUND OF THE INVENTION

A number of elastomeric polymers, such as polybutadiene, natural rubber, styrene butadiene rubber, and isoprene rubber, have been used as the base polymer in the manufacture of golf ball cores. Today, golf ball cores are predominantly made from compositions comprising polybutadiene, which provides the primary source of resiliency for the golf ball. Further increase in core resiliency can be achieved by increasing the cross-link density of the polybutadiene. A peroxide-based free radical initiator such as dicumyl peroxide is typically added in conjunction with a crosslinking agent such as zinc diacrylate and/or zinc dimethacrylate to crosslink polybutadiene and obtain the desired physical properties for the golf ball cores. Zinc oxide is also added to the composition, both as a density-modifying filler and as an activation agent for the zinc diacrylate/peroxide curing system. The core is protected by a cover, and may comprise additional layers in between, such as outer core layers, intermediate layers, or inner cover layers. Any one of these additional layers may be a wound layer of tensioned elastic windings.

A crosslinking agent is fully effective only if it is thoroughly and homogeneously dispersed throughout the base polymer. At the relatively high mixing temperatures required for the base polymer, many organic peroxides become thermally unstable, making it impossible to achieve a homogeneous dispersion of the crosslinking agent in the base polymer. Best results have been obtained with dialkyl and diaralkyl peroxides, for instance di-t-butyl peroxide ("DTBP") and dicumylperoxide ("DCP"), but not without shortcomings. DTBP is so volatile that its use is very much limited. DCP can be used under normal operating conditions only at the cost of considerable environmental pollution since its principal decomposition product is acetophenone, which imparts to the finished product and to the environment a very intensive unpleasant odor.

Therefore, a need remains for a golf ball core composition that minimizes the above-described problems and provides a golf ball core with improved characteristics, such as compression, initial velocity, durability and resiliency. The present invention provides such core compositions for golf balls.

SUMMARY OF THE INVENTION

The present invention is directed to a golf ball having a core and a cover, particularly to a golf ball core or cover having an elastomeric composition formed from a base polymer and at least one carbon-carbon initiator. When heated to a decomposition temperature of about 150° C. to about 300° C., the carbon-carbon initiator breaks along an elongated carbon-carbon single bond of at least about 0.155 nm in length with a half-life of about 10 hours to about 0.1 hours to form carbon-base free radicals that facilitates the crosslinking in the base polymer.

Suitable carbon-carbon initiators for the present invention include, but are not limited to, aliphatic hydrocarbon initiators, alicyclic hydrocarbon initiators, aromatic hydrocarbon initiators, substituted carbon-carbon initiators, and oligomeric carbon-carbon initiators. Most preferred are hydrocarbon initiators that are compatible with the base polymer.

One group of the carbon-carbon initiators has a formula of:

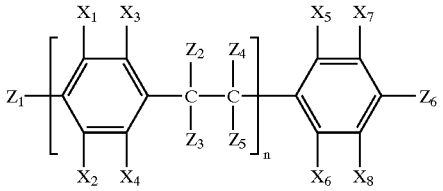

where n is an integer from 1 to about 10; $X_1$ to $X_8$ are independently selected from hydrogen, halogen, linear or branched alkyl, alkoxy, cyano, nitro, nitrile, hydroxyl, or amino groups; and $Z_1$ to $Z_6$ are independently selected from hydrogen, halogen, linear or branched alkyl, alkoxy, aryl, aryloxy, cycloalkyl, substituted cycloalkyl, vinyl, phenyl, substituted phenyl, cyano, nitro, nitrile, hydroxyl, amino, carboxyl, ester, amide, thio, epoxide, silyl, or silyloxy groups. Preferably, each of $X_1$ to $X_8$ and $Z_1$ to $Z_6$ has no more than about 20 carbon atoms. Among these carbon-carbon initiators, 2,3-dimethyl-2,3-diphenylbutane, 3,4-dimethyl-3,4-diphenylhexane, poly(1,4-diisopropylbenzene), and combinations thereof are most preferred.

Another group of the carbon-carbon initiators has a formula of:

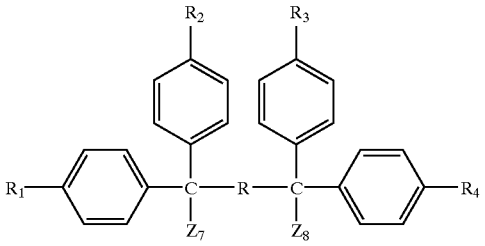

where R is a substituted hydrocarbon moiety; $R_1$ to $R_4$ are independently selected from hydrogen, alkyl, or alkoxy groups; and $Z_7$ and $Z_8$ are independently selected from hydrogen, halogen, linear or branched alkyl, alkoxy, aryl, aryloxy, cycloalkyl, substituted cycloalkyl, vinyl, phenyl, substituted phenyl, cyano, nitro, nitrile, hydroxyl, amino, carboxyl, ester, amide, thio, epoxide, silyl, or silyloxy groups. Preferably, each of $R_1$ to $R_4$ and $Z_7$ to $Z_8$ has no more than about 20 carbon atoms.

The base polymer can be any polymers suitable for golf ball application, but preferably comprises at least one polybutadiene having a Mooney viscosity of about 20 to about 150. The carbon-carbon initiator is present in an amount of about 0.01 phr to about 100 phr by weight of the base polymer, preferably about 0.01 phr to about 30 phr, more preferably about 0.1 phr to about 10 phr, and most preferably about 0.5 phr to about 5 phr. In one embodiment, the elastomeric composition is substantially free of peroxide initiators, sulfur-based curing agents, and crosslinking agents. In an alternative embodiment, the composition incorporates at least one of a peroxide initiator, a crosslinking agent, a halogenated thiophenol compound, an accelerator, a free radical scavenger, a scorch retarder, a stable free radical, a filler, an antioxidant, or a processing aid or oil. When a crosslinking agent is used, the preferred weight ratio of the carbon-carbon initiator to the crosslinking agent is about 0.01:1 to about 5:1. When a peroxide initiator is used, the preferred weight ratio of the carbon-carbon initiator to the peroxide initiator is about 0.05:1 to about 50:1. The peroxide initiator preferably has a decomposition temperature lower than that of the carbon-carbon initiator.

The elastomeric composition with the carbon-carbon initiator is employed in golf balls, particularly in the cores, to achieve certain desirable properties. For example, the carbon-carbon initiator is used in an amount sufficient to increase the core compression by at least about 5%, or to increase the core COR by at least about 0.001. In core compositions where a halogenated thiophenol is used to lower the core compression, the carbon-carbon initiator is preferably present in an amount sufficient to increase the core compression by at least about 20%.

The elastomeric composition of the present invention is useful in single-piece cores, and in centers or outer core layers of two-piece or multi-piece cores. The core preferably has a diameter of about 1.55 inches to about 1.65 inches. These cores are suitable in golf balls of any constructions. For example, the golf ball may have an intermediate layer or a barrier layer disposed between the core and the cover. The overall thickness of the cover is preferably about 0.01 inches to about 0.07 inches. The cover may have a single layer, or an outer cover layer and one or more inner cover layers, at least one which is formed from a thermoplastic or thermoset polyurethane or polyurea. In one embodiment, the inner cover layer comprises a thermoplastic material; and the outer cover layer is softer than the inner cover layer.

DEFINITIONS

As used herein, the term "carbon-carbon free radical initiators" or "C—C initiators" refers to free radical initiators that are thermally decomposable into free radicals by breaking one or more elongated and therefore weakened carbon-carbon single bonds. These C—C initiators and their subgroups are also known, among others, as C—C labile compounds, organic compounds having unstable or labile C—C bonds, pure hydrocarbon initiators, aromatic hydrocarbons, highly branched alkanes, sterically-crowded phenyl-substituted alkanes, bibenzyl or diphenyl curing catalysts, dicumyl compounds or synergists, alkyl-substituted diphenyl compounds, substituted succinates, diphenylethane derivatives, pinacoles or pinacolones and derivatives thereof, silylbenzopinacoles and derivatives thereof, non-peroxide free radical initiators, oxygen-free radical donors or activators, carbon radical donors, carbon radical activators, carbon radical promoters, or carbon radical generators.

As used herein, the term "Mooney viscosity" is defined as the shearing torque resisting rotation of a cylindrical metal disk (or rotor) embedded in rubber within a cylindrical cavity. Mooney viscosity is commonly used to measure the plasticity of raw or pre-vulcanized rubber. In the present invention, the Mooney viscosity is measured in accordance with ASTM D1646-00.

As used herein, the term "polyahl" or "reactive polyahl" refers to any one compound or a mixture of compounds containing a plurality of primary or secondary active hydrogen moieties per molecule. Illustrative of such active hydrogen moieties are —OH (hydroxy group), —SH (thio group), —COOH (carboxylic acid group), and —NHR (amine group) with R being hydrogen, alkyl, aryl, or epoxy. These active hydrogen moieties are reactive to free isocyanate groups, forming urethane, urea, thiourea or corresponding linkage depending on the particular active hydrogen moiety being reacted. The polyahls may be monomers, homo-oligomers, co-oligomers, homopolymers, or copolymers. The polyahls are generally liquids or solids meltable at relatively low temperatures.

As used herein, the term "saturated" or "substantially saturated" means that the compound or material of interest is fully saturated (i.e., contains no double bonds, triple bonds, or aromatic ring structures), or that the extent of unsaturation is negligible, e.g. as shown by a bromine number in accordance with ASTM E234-98 of less than 10, preferably less than 5.

As used herein, the term "water vapor transmission rate" ("WVTR") refers to the mass of water vapor that diffuses into a material of a given thickness per unit area per unit time at a specific temperature and humidity differential. Standard tests for WVTR include ASTM E96-00.

As used herein, the term "flexural modulus" or "modulus" refers to the ratio of stress to strain within the elastic limit (measured in flexural mode) of a material, indicates the bending stiffness of the material, and is similar to tensile modulus. Flexural modulus, typically reported in Pascal ("Pa") or pounds per square inches ("psi"), is derived in accordance to ASTM D6272-02.

As used therein, the term "compression," also known as "ATTI compression" or "PGA compression," refers to points derived from a Compression Tester (ATTI Engineering Company, Union City, N.J.), a scale well known in the art for determining relative compression of a spherical object. Compression is a property of a material as measured on a golf ball construction (i.e., on-ball property), not a property of the material per se.

As used herein, the term "coefficient of restitution" or "COR" for golf balls is defined as the ratio of a ball's rebound velocity to its initial incoming velocity when the ball is fired out of an air cannon into a rigid vertical plate. The faster a golf ball rebounds, the higher the COR it has, the more the total energy it retains when struck with a club, and the longer the ball flies. The initial velocity is about 50 ft/s to about 200 ft/s, and is usually understood to be 125 ft/s, unless otherwise specified. A golf ball may have different COR values at different initial velocities.

The term "about," as used herein in connection with one or more numbers or numerical ranges, should be understood to refer to all such numbers, including all numbers in a range.

DETAILED DESCRIPTION OF THE INVENTION

Golf balls of the present invention may have a variety of constructions, comprising at least a core, a cover and, optionally, an intermediate layer disposed between the core and the cover. The core may be a single solid mass, or include a center and one or more outer core layers. The center may further be solid, liquid-filled, gel-filled, or gas-filled. The intermediate layer may include a plurality of layers. The cover may include one or more inner cover layers and an outer cover layer. Any of the outer core layers, the intermediate layers, or the inner cover layers may be a wound layer formed of a tensioned elastomeric material, a molded layer, an adhesive or coupling layer, a continuous or discontinuous layer, a lattice network, a web or net, a layer with uniformed or non-uniformed thickness, a layer having a plurality of discrete elements such as islands and protrusions, a metallic layer, or a foamed layer. While the compositions of the present invention may be present in any of the layers described above, they are preferably present in either a core or an intermediate layer. More preferably, the compositions of the invention are present in the core.

The golf ball cores of the present invention preferably has at least one solid portion, such as a center, a core layer, or the entire core. The core, particularly the solid portion, preferably comprises a reaction product of a base polymer and an initiator. Any natural or synthetic rubbers, thermoplastic or thermoset elastomers, castable materials, or combinations thereof can be chosen as the base polymer. Exemplary core materials include balata (trans-polyisoprene), gutta-percha, natural or synthetic rubbers, polybutadienes, polyisoprenes, ethylene-propylene rubbers, styrene-butadiene rubbers, styrene-propylene-diene rubbers, chloroprene rubbers, acrylonitrile rubbers, acrylonitrile-butadiene rubbers, polysulfide rubbers, rubbers synthesized via the co-polymerization of functionalized monomers using metallocene catalysts or other single-site catalysts, ethylene-propylene-diene terpolymers ("EPDM"), styrene-ethylene block copolymers, maleic anhydride or succinate modified metallocene catalyzed ethylene copolymers, polypropylene resins, chlorinated polyethylenes, ionomer resins, polyamides, polyethers, polyesters, polyurethanes, polyureas, polyimides, polysiloxanes, silicones, epoxies, fluorocarbons, and the like or combinations thereof. Suitable thermoplastic elastomers include polyetheramides such as Pebax® from AtoFina Chemicals Inc., polyetheresters such as Hytrel® from E.I. Du Pont de Nemours and Company, polyurethanes from various manufacturers, and styrenic block copolymers such as Kraton® from Shell Chemical Company. Additionally, suitable core materials also include reaction injection molded ("RIM") polyurethanes or polyureas. Preferred RIM polyurethanes are nucleated versions, where a gas, such as nitrogen, is whipped into the prepolymer prior to injection into a closed mold to form the polyurethane layer.

In a preferred embodiment, the base polymer comprises a polybutadiene having a cis-1,4-isomer content of at least about 40%, a Mooney viscosity of at least about 20, a molecular weight of at least about 100,000, and a polydispersity of less than about 4. The cis-1,4-isomer content is preferably greater than about 90%, more preferably greater than about 95%. The Mooney viscosity is preferably at least about 30, more preferably about 35 to about 150, and most preferably about 50 to about 100. The molecular weight is preferably greater than about 150,000, more preferably greater than about 200,000, and most preferably from about 300,000 to about 500,000. The polydispersity is preferably less than about 3, more preferably less than about 2, and most preferably less than about 1.5. The polybutadiene may be formed with a metal catalyst, such as a cobalt, zinc, or nickel catalyst, or a rare earth metal catalyst, such as a neodymium catalyst.

In another embodiment, the base polymer comprise a blend of two or more polybutadiene rubbers that are different in at least one aspect, such as the catalyst used, molecular weight, Mooney viscosity, polydispersity, cis-isomer content, trans-isomer content, vinyl content, melt flow rate, filler content, filler type, weight, or volume. Preferably, a first polybutadiene of the blend is made with a cobalt, nickel or zinc catalyst, and has a Mooney viscosity of from about 50 to about 150. A second polybutadiene of the blend may be made with a neodymium catalyst, having a Mooney viscosity of from about 20 to about 100. Weight ratio and volume ratio between the first and second polybutadienes are in the range of about 5:95 to about 95:5.

Examples of desirable polybutadiene rubbers include Buna® CB22 and CB23 from Bayer, Ubepol® 360L and 150L from Ube Industries, Cariflex® BCP820 and BCP824 from Shell Chemical, and Kinex® 7245 and 7265 from Goodyear. The polybutadiene or blends thereof is present in an amount of preferably at least about 40% by weight of the total composition, and may be mixed with one or more suitable base polymer materials known to one of ordinary skill in the art, such as those mentioned above, at any weight or molar ratios, to modify the properties of the core. Other polybutadiene blends include those disclosed in U.S. patent application Ser. No. 10/164,809, the entire disclosure of which is incorporated by reference herein.

Suitable crosslinking agents for the polybutadiene-based solid cores include salts of unsaturated fatty acid having 3 to 8 carbon atoms, such as acrylic, methacrylic, cinnamic and crotonic acids. Suitable counterions include but are not limited to quaternary phosphonium or ammonium cations, such as tetraalkyl phosphonium, and metal cations, such as sodium, lithium, potassium, magnesium, calcium, zinc, barium, aluminum, tin, zirconium, nickel and cadmium. Other crosslinking agents may comprise unsaturated vinyl compounds, such as N,N'-m-phenylene dimaleimide (available as Vanax® MBM from R.T. Vanderbilt), trimethylolpropane trimethacrylate (Sartomer® SR-350 from Sartomer), triallyl trimellitate (Triam® 705 from Wako Chemicals), triallylisocyanurate (Taic® from Nippon Kasei Chemical), and acrylate terminated liquid polybutadiene (PolyBD® 300 from Elf Atochem N.A.).

More preferably, the cross-linking agent is a mono-(meth) acrylic acid or di-(meth)acrylic acid metal salt, wherein the cation is zinc, sodium, magnesium, or mixtures thereof. Even more preferably, the cross-linking agent is zinc diacrylate ("ZDA"), zinc dimethacrylate ("ZDMA"), zinc acrylate, zinc methacrylate, or mixtures thereof. ZDA is most preferred because it provides golf balls with a high initial velocity, but the present invention is not limited thereto. ZDA can be of various grades; preferably ZDA contains less than about 10% zinc stearate, more preferable from about 4% to about 8%. Commercial sources for ZDA include Rockland React-Rite and Sartomer. The crosslinking agent may be present in the core composition in any amount. For example, the crosslinking agent content may be 0 to about 25 parts per 100 parts by weight of the base polymer ("phr") or, alternatively, greater than about 40 phr, preferably about 40 phr to about 60 phr. In one embodiment, the crosslinking agent content is from about 15 phr to about 40 phr. Base polymers having little or no ZDA have low water vapor transmission rates. They are less prone to moisture absorption and related deterioration in playability and performance because of the low permeability.

Conventional thermal initiators used to promote the crosslinking reaction in the core are peroxide initiators, azo initiators, persulfates, hydrazines, hydrazides, benzophenones, or blends thereof that decompose into free radicals during the cure cycle. Suitable peroxide initiators include organic peroxide compounds, such as DCP, DTBP, 1,1-di(t-butylperoxy)-3,3,5-trimethylcyclohexane, α,α'-bis (t-butylperoxy)diisopropylbenzene, 2,5-dimethyl-2,5 di(t-butylperoxy)hexane, t-butylcumyl peroxide, diisopropylbenzene hydroperoxide, p-menthane hydroperoxide, 2,5-dimethyl-2,5-di-(t-butylperoxy)-hexyl-3,1,1,3,3-tetramethylbutyl hydroperoxide, 2,5-dimethylhexane-2,5-dihydroperoxide, cumene hydroperoxide, t-butylhydroperoxide, 1,1-bis(t-butylperoxy)-cyclohexane, t-butyl-peroxymaleic acid, t-butyl-peroxylaurate, t-butylperoxy-3,5,5-trimethylhexanoate, cyclohexanone peroxide, t-butyl-peroxyisopropylcarbonate, 2,5-dimethyl-2,5-di(benzoylperoxy)-hexane, 2,2'-bis(t-butylperoxy) octane, t-butyl peroxyacetate, 2,2-bis(t-butylperoxy)butane, t-butylperoxy benzoate, n-butyl-4,4-bis(t-butylperoxy) valerate, di-(t-butyl-diperoxy)isophthalate, methylethylketone peroxide, 2,5-dimethyl-2,5-di(t-butylperoxy)hexane, t-butyl hydroperoxide, m-toluoyl peroxide, t-butylperoxy isobutyrate, octanoyl peroxide, decanoyl peroxide, lauroyl peroxide, stearoyl peroxide, propionyl peroxide, succinic acid peroxide, acetyl peroxide, di-t-amyl peroxide, benzoyl peroxide, di(2-t-butyl-peroxyisopropyl)benzene peroxide, or blends thereof. Commercial examples of suitable peroxide initiators include, but are not limited to, Varox® 231XL and DCP-R from AtoFina, Perkadox® BC and 14 from Akzo Nobel, and Elastochem® DCP-70 from Rhein Chemie. Other peroxides and mixtures of peroxides having different activation temperatures may be employed.

Unlike the peroxide initiators, C—C initiators have chemical structures that are free of peroxide groups. Rather, the C—C initiators have at least one carbon-carbon single bond that is elongated by suitable neighboring moieties, rendering the bond weakened and labile (i.e., unstable). When heated, the C—C initiators decompose and give rise to carbon-based free radicals by splitting along these elongated and labile carbon-carbon single bonds, which are typically at least about 0.155 nm in length. The C—C initiators are substantially void of the disadvantages associated with peroxides in crosslinking polyolefins such as polybutadiene as mentioned above, or at least display these disadvantages to a reduced extent. The C—C initiators are capable of splitting the labile C—C bond(s) in a temperature range of about 150° C. to about 300° C. The half-life values of these C—C initiators in the temperature range preferred for crosslinking, i.e. about 150° C. to 300° C., is between about 10 hours and about 0.1 hours. Because of their long half-lives at the low end of the operating temperature range, i.e. about 160° C., the C—C initiators can be well mixed into the polymer during the heat-melting phase while remaining in an effective amount, without undergoing noticeable premature decomposition and subsequent initiation of crosslinking of the base polymer. The C—C initiators become markedly more active at temperatures above 190° C.; but even at such a high temperature, thorough mixing of the C—C initiator into the base polymer proceeds well without noticeable premature crosslinking, which can be detected by an increase in the resistance to kneading. High stability at high temperatures make these C—C initiators very attractive both as thermal initiators and as crosslinking agents for polybutadiene-based golf ball cores or layers.

Also because of their high decomposition temperatures, the C—C initiators have high modification efficiency. They do not attack the base polymers prematurely or vigorously, therefore do not cause premature crosslinking or gelation. Because these C—C initiators are free of oxygen radicals, they reduce the occurrence of oxidation, decomposition, outgassing, and discoloration in the base polymer. Other advantageous impact of the C—C initiators on the base polymer include enhanced adhesion and moldability, reduced changes in melt flow rate, and narrowed molecular weight distribution (i.e., lowered polydispersity).

Suitable C—C initiators for the present invention include pure hydrocarbon initiators (aliphatic, alicyclic, or aromatic); substituted C—C initiators having any number of moieties such as halogen (fluorine, chlorine, bromine, or iodide), alkyl, alkoxy, aryl (such as phenyl, naphthyl, 5- or 6-membered heterocyclic rings with a π-electron system and N, O, or S as heteroatoms), aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups; and oligomeric C—C initiators. Pure hydrocarbon initiators are preferred because they are fully compatible with the base polymers to be crosslinked, and are capable of being added at any stage at any amount. In addition, these pure hydrocarbon initiators are not very volatile, odorless, easy to handle, and cause no storage problems.

One group of C—C initiators shares the following structure:

(I)

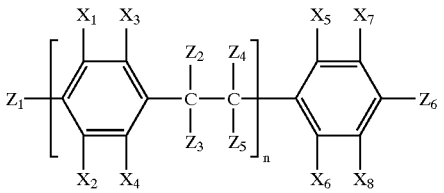

where n is an integer from 1 to about 10; $Z_1$ to $Z_6$ are independently selected from hydrogen, halogen, linear or branched alkyl, alkoxy, aryl (such as phenyl, naphthyl, 5- or 6-membered heterocyclic rings with a π-electron system and N, O, or S as heteroatoms), aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups; and $X_1$ to $X_8$ are independently selected from hydrogen, halogen, linear or branched alkyl, alkoxy, cyano, nitro, nitrile, hydroxyl, or amino groups. Each of $X_1$ to $X_8$ and $Z_1$ to $Z_6$ preferably has no more than about 20 carbon atoms, more preferably less than about 8 carbon atoms, and most preferably less than about 6 carbon atoms. For example, when n is 1, $Z_1$, $Z_6$, and $X_1$ to $X_8$ are all hydrogen, and $Z_2$ to $Z_5$, are all methyl, the C—C initiator of (I) becomes 2,3-dimethyl-2,3-diphenylbutane (CAS# 1889-67-4) with the following chemical structure:

(II)

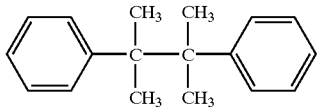

Another group of C—C initiators has the following formula:

(III)

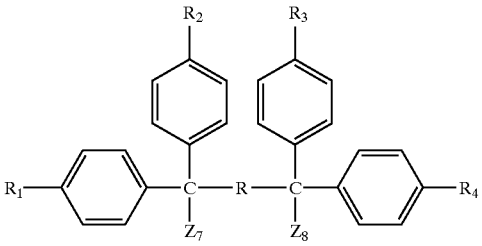

where R is substituted hydrocarbon moiety, $R_1$ to $R_4$ are independently selected from hydrogen, alkyl, or alkoxy groups, and $Z_7$ and $Z_8$ are independently selected from hydrogen, halogen, linear or branched alkyl, alkoxy, aryl (such as phenyl, naphthyl, 5- or 6-membered heterocyclic rings with a π-electron system and N, O, or S as heteroatoms), aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups. An exemplary C—C initiator of the formula (III) is 3-methoxycarbonyl-3-methyl-2,2,5,5-tetraphenylhexandinitrile.

Examples of C—C initiators include: bibenzyl; α,α'-dimethoxybibenzyl; α,α'-dimethoxy-α,α'-dimethylbibenzyl; α-methoxy-α,α'-diphenylbibenzyl; α,α'-dimethoxy-α,α'-diphenylbibenzyl; 1,2-dinitro-1,2-diphenylethane; 1,2-dinitro-1,2-di(p-tolyl)ethane; 1,2-dichloro-1,2-diphenylethane; 1,2-dibromo-1,2-diphenylethane; 1,2-dibromo-1,2-dimethyl-1,2-diphenylethane; tetraphenylethane; hexaphenylethane; tetrabromodiphenylethane; pentabromodiphenylethane; hexabromodiphenylethane; heptabromodiphenylethane; octabromodiphenylethane; novabromodiphenylethane; decabromodiphenylethane; 1,2-bis(trimethylsiloxy)-1,2-diphenylethane; 1,2-diphenyl-1,2-ethanediol (i.e.; hydrobenzoin); 1,1,2,2-tetraphenyl-1,2-ethanediol (i.e.; benzopinacol or tetraphenylethylene glycol); 2,3-dimethyl-2,3-butanediol (i.e.; pinacol; pinacone; or tetramethylethylene glycol); 2,3-diphenyl-2,3-butanediol; 3,4-diphenyl-3,4-hexanediol; 1,2-bis(trimethylsiloxy)-1,1,2,2-tetraphenylethane; 2,3-bis(trimethylsilyloxy)-2,3-diphenylbutane; 2,3-bis(trimethylsilyloxy)-2,2,3,3-tetraphenylbutane; 2,3-diethyl-2,3-diphenylsuccinonitrile (i.e.; diethyl-2,3-dicyano-2,3-diphenylsuccinate); 2,2,3,3-tetraphenylsuccinonitrile; 2,3-dimethylbutane; 2,3-diphenylbutane; 2-methyl-2,3-diphenylbutane; 2,3-dimethyl-1,1-diphenylbutane; 2,3-dimethyl-1,2-diphenylbutane; 2,3-dimethyl-1,4-diphenylbutane; 2,3-dimethyl-2,3-diphenylbutane; 2,3-diethyl-2,3-diphenylbutane; 2-methyl-3-ethyl-2,3-diphenylbutane; 2,3-dipropyl-2,3-diphenylbutane; 2,3-dibutyl-2,3-diphenylbutane; 2,3-diisobutyl-2,3-diphenylbutane; 2,3-dihexyl-2,3-diphenylbutane; 2-methyl-2-phenyl-3-tolylbutane; 2-methyl-3-phenyl-2-tolylbutane; 2-benzyl-3-methyl-1-phenylbutane; 2,2,3,3-tetraphenylbutane; 2,3-dimethyl-2,3-di(p-methylphenyl)butane; 2,3-diethyl-2,3-di(p-methylphenyl)butane; 2,3-dimethyl-2,3-di(p-tolyl)butane; 2,3-dimethyl-2,3-di[p-(t-butyl)phenyl]butane; 1,4-bis(1-bora-3,4-diphenylcyclopentyl)-2,3-diphenylbutane; 2,3-dimethyl-2-methylphenyl-3-[(p-2',3'-dimethyl-3'-methylphenyl-butyl)phenyl]butane; 2,3-dimethyl-2,3-di(p-isopropylphenyl)butane; 2,3-dimethyl-2,3-di(p-benzylphenyl)butane; 2,3-dimethyl-2,3-di(2,3,4,5,6-pentamethylphenyl)butane; 2,3-dimethyl-2,3-di(m-hexadecylphenyl)butane; 2,3-dimethyl-2,3-di(p-eicosylphenyl)butane; 2-methyl-3-isopropyl-2,3-di(p-isobutylphenyl)butane; 2,3-dicyano-2,3-diphenylbutane; 2,3-dimethyl-2,3-di(p-methoxyphenyl)butane; 2,3-dimethyl-2,3-di(p-ethoxyphenyl)butane; 2,3-dimethyl-2,3-di(p-chlorophenyl)butane; 2,3-dimethyl-2,3-di(p-bromophenyl)butane; 2,3-dimethyl-2,3-di(p-iodophenyl)butane; 2,3-dimethyl-2,3-di(p-nitrophenyl)butane; 2,3-diethyl-2,3-di(p-chlorophenyl)butane; 2,3-diethyl-2,3-di(p-bromophenyl)butane; 2,3-diethyl-2,3-di(p-iodophenyl)butane; 2,3-diethyl-2,3-di(p-nitrophenyl)butane; 2-methyl-1,1-diphenylpentane; 4-methyl-1,1-diphenylpentane; 2-methyl-1,2-diphenylpentane; 4-methyl-1,2-diphenylpentane; 2-methyl-1,3-diphenylpentane; 4-methyl-1,3-diphenylpentane; 2-methyl-1,4-diphenylpentane; 2-methyl-1,5-diphenylpentane; 4-methyl-2,2-diphenylpentane; 2-methyl-2,3-diphenylpentane; 2-methyl-2,4-diphenylpentane; 2-methyl-3,4-diphenylpentane; 2-methyl-2,5-diphenylpentane; 2-methyl-3,3-diphenylpentane; 3,4-dimethylhexane; 3,4-dimethyl-3,4-diethylhexane; 1,1-diphenylhexane; 1,2-diphenylhexane (i.e.; 2-benzyl-1-phenylpentane); 1,3-diphenylhexane; 1,4-diphenylhexane; 1,5-diphenylhexane; 1,6-diphenylhexane; 2,2-diphenylhexane; 2,3-diphenylhexane; 2,4-diphenylhexane; 2,5-diphenylhexane; 3,3-diphenylhexane; 3,4-diphenylhexane; 2,3-dimethyl-2,3-diphenylhexane; 3,4-dimethyl-3,4-diphenylhexane; 3,4-diethyl-3,4-diphenylhexane; 3,4-dipropyl-3,4-diphenylhexane; 3,4-diisobutyl-3,4-diphenylhexane; 3,3,4,4-tetraphenylhexane; 3,4-diethyl-3,4-di(3,4,5-triethylphenyl)hexane; 4,5-dimethyl-4,5-diphenyloctane; 4,5-dipropyl-4,5-diphenyloctane; 5,6-dimethyl-5,6-diphenyldecane; 5,6-dimethyl-5,6-di(p-cyclohexylphenyl)decane; 6,7-dimethyl-6,7-diphenyldodecane; 7,8-dimethyl-7,8-di(p-methoxyphenyl)tetradecane; 1,1'-diphenyl-1,1'-bicyclopentyl; 1,1'-diphenyl-1,1'-bicyclohexyl; poly(1,4-diisopropylbenzene); and poly(1,3-diisopropylbenzene). Other C—C initiators useful in the present invention include substituted succinates, silylpinacolone ethers, 1,2-diphenylethane derivatives as disclosed in U.S. Pat. No. 4,556,695, pinacol or pinacolone and derivatives thereof as disclosed in U.S. Pat. Nos. 4,117,017 and 4,135,047, and silylbenzopinacoles as disclosed in U.S. Pat. No. 4,948,820. These patents are incorporated herein by reference in their entirety.

Any of the C—C initiators as disclosed herein may be used solely or in combinations of two or more. Preferred commercially available C—C initiators for the present invention include 2,3-dimethyl-2,3-diphenylbutane (CAS# 1889-67-4, from Akzo Nobel under the tradename of Perkadox® 30, from Degussa under the brand name of CCDFB-90, and from Nippon Oil & Fat Corporation under the tradename of Nofiner® BC); 3,4-dimethyl-3,4-diphenylhexane (CAS# 10192-93-5, from Degussa under the brand name of CCDFH); poly(1,4-diisopropylbenzene) (CAS# 100-18-5, from Degussa under the brand name of CCPIB); and combinations thereof.

The amount of the C—C initiator(s) present in the golf ball core compositions of the present invention is at least about 0.01 phr by weight of the base polymer, but less than about 100 phr, and may be adjusted according to the specific composition. The amount of the C—C initiator(s) preferably ranging from about 0.05 phr to about 50 phr, more preferably from about 0.1 phr to about 30 phr, and most preferably from about 0.5 phr to about 10 phr. The actual amount of the C—C initiator added varies depending on the specific initiator compound used and the intended composition to be produced. In the absence of a halogenated thiophenol compound as described in detail below, the carbon-carbon initiator is preferably used in an amount sufficient to increase the core compression by at least about 5%, more preferably by at least about 10%, or to increase the core COR by at least about 0.001. In core compositions where a halogenated thiophenol is used to significantly lower the core compression, the carbon-carbon initiator is preferably present in an amount sufficient to increase the core compression by at least about 20%, preferably by at least about 50%, or to increase the core COR by at least about 0.003, preferably by at least about 0.005.

In one embodiment, the C—C initiators are used alone or in combination of two or more thereof as the curative system for the base polymer, without any peroxide initiators or crosslinking agents described above. As described above, C—C initiators are capable of cross-linking polyolefins as well. In another embodiment, the C—C initiators, alone or in combination of two or more thereof, are used as the initiator in combination with one or more of the crosslinking agents mentioned above, such as ZDA, to crosslink the base polymer. In a further embodiment, at least one C—C initiator, at least one peroxide initiator, and at least one crosslinking agent are used together as a curative system to crosslink the base polymer. When one or more of the crosslinking agent is used, the C—C initiator is present in an amount of at least about 0.1% by weight of the crosslinking agent, preferably from about 0.5% to about 50%, more preferably from about 1% to about 30%, and most preferably from about 2% to about 10%. When one or more of the peroxide initiators is present, the weight ratio of the C—C initiator to the peroxide initiator is preferably from about 0.05:1 to about 50:1.

In another embodiment, a blend of at least two thermal initiators are used in crosslinking the base polymer. A first thermal initiator has a relatively low decomposition temperature, preferably about 100° C. to about 160° C.; a second thermal initiator has a relatively high decomposition temperature, preferably about 150° C. to about 300° C. The half-life of the second thermal initiator is preferably at least 10 times, more preferably at least 20 times, and most preferably 100 times longer than that of the first thermal initiator during mixing, at a temperature lower than the decomposition temperature of the first thermal initiator. At least one of these two thermal initiators is a C—C initiator of the present invention. Preferably, the first thermal initiator is a peroxide initiator, and the second thermal initiator is a C—C initiator.

Other means to promote the crosslink reaction in the base polymer include high-energy radiation sources capable of generating free radicals, such as electron beam, gamma radiation, infrared radiation, ultra-violet radiation, X-ray radiation, as well as heating. Alternatively, sulfur-based curing agents with optional accelerators may be used in combination with or in replacement of the peroxide initiators to crosslink the base polymer.

In polybutadiene-based solid cores of the present invention, it is preferred to blend in a halogenated thiophenol or a metal salt thereof, to further enhance the resiliency of the core. The halogenated thiophenol compounds, preferably pentachlorothiophenol ("PCTP") or ZNPCTP, function in part as a cis-to-trans catalyst that convert cis-1,4 bonds in the polybutadiene to trans-1,4 bonds. Utilization of such halogenated thiophenol compounds in golf balls to produce soft and fast cores is disclosed in co-pending U.S. Patent Application Publication No. 2003/0064826, which is incorporated by reference herein in its entirety. PCTP is available under the tradename Struktol® A95 from Struktol Company of America, and ZnPCTP is available from eChinaChem. The halogenated thiophenol compounds are present in an amount of at least about 0.1 phr, more preferably about 2 phr to about 50 phr, and most preferably about 2.3 phr to about 30 phr. In one embodiment, the halogenated thiophenol compounds are used in an amount of from about 0.5 phr to about 2.3 phr in combination with less than about 25 phr or greater than about 40 phr of a crosslinking agent such as ZDA.

The solid core may also include fillers to adjust hardness, stiffness, strength, modulus, weight, density and/or specific gravity of the core. Suitable fillers include metal or alloy powders, metal oxides and salts, ceramics, particulate, carbonaceous materials, polymeric materials, glass microspheres, and the like or blends thereof. These fillers may be solid or hollow, and filled or unfilled. Examples of useful metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, leafing or non-leafing aluminum flakes, tungsten metal powder, beryllium metal powder, zinc metal powder, or tin metal powder. Examples of metal oxides include but are not limited to zinc oxide, iron oxide, aluminum oxide, titanium dioxide, magnesium oxide, zirconium oxide, and tungsten trioxide. Examples of particulate carbonaceous materials include but are not limited to graphite and carbon black. Examples of other useful fillers include but are not limited to graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (which is recycled uncured center material mixed and ground to 30 mesh particle size), manganese powder, and magnesium powder. Preferred fillers include tungsten, tungsten oxide, tungsten metal powder, barium sulfate, carbon black, silica, titanium oxide, or a mixture thereof in the forms of nano-scale or micro-scale fibers, filaments, flakes, whiskers, wires, tubes, or particulate.

Alternative fillers include foaming agents, blowing agents, micro balloons, cellular foams and other materials having a relatively large void volume. Such fillers may include hollow spheres or microspheres that can be incorporated into a polymeric matrix of epoxy, urethane, polyester or any suitable binder, or air pockets that are present in chemically or physically foamed thermoplastic or thermosetting polymers. Fillers may also include various polymers, ceramics, and glass microspheres that are solid or hollow, and filled or unfilled, all of which are readily selected by one of ordinary skill in the art. The amount and type of the filler utilized is governed by the amount and weight of other ingredients in the composition, since a maximum golf ball weight of 1.620 ounces has been established by the United States Golf Association. The filler is generally added in an amount ranging from about 0 phr to about 70 phr. Preferably, the amount of the filler added ranges from about 10 phr to about 50 phr.

Other optional additive for the golf ball core are well known in the art, and may be blended into the core in amounts sufficient to achieve their specific purposes and desired effects. Such additives include antioxidants to prevent premature crosslinking and molecular breakdown of the base polymer, accelerators to speed up the polymerization reaction, processing aids oils to affect rheological and mixing properties, foaming agents, cis-to-trans catalysts, adhesives, coupling agents, stable free radicals, radical scavangers, scorch retarders, and blends thereof. It is possible to employ the C—C initiator conjointly with a suitable accelerator for curing in the core composition. As known to the skilled in the art, the accelerators include amines (such as tertiary amines or those having a cyclic or phenyl structure, used alone or in combination with an organic compound of a transition metal), imidazoles, heterocyclic compounds comprising nitrogen (such as diazabicycloundecene), organic phosphine compounds, complexes of an organic phosphine and an organic boron, complexes of an amine and an organic boron, quaternary ammonium compounds, quaternary phosphonium compounds, and the like or combinations thereof.

The core of the golf ball of the present invention preferably has a diameter of at least about 0.5 inches, more preferably about 1.5 inches to about 1.65 inches, and most preferably about 1.55 inches to about 1.64 inches. The core has a compression of less than about 100, preferably from about 20 to about 90. The core should also be highly resilient, having a COR of preferably greater than about 0.75, more preferably greater than about 0.78. The core may be harder on the outside than on the inside, with a peripheral hardness greater than a central hardness by at least about 5 Shore C. Conventional methods and techniques may be used to form the solid cores from the base compositions disclosed herein.

Any of the core compositions described above, using the C—C initiator to promote crosslink reaction within the base polymer, may likewise be used in any intermediate layers disposed between a center of the core and an outermost cover layer in a golf ball. Such intermediate layers may also be referred to as outer core layers, inner cover layers, or mantle layers. C—C initiators may be used with other materials suitable for the intermediate layers. Such materials include thermoset or thermoplastic elastomers, such as natural rubbers; balata; gutta-percha; cis-polybutadienes; trans-polybutadienes; synthetic polyisoprenes; polyoctenamers; styrene-propylene-diene rubbers; metallocene rubbers; styrene-butadiene rubbers; ethylene-propylenes; chloroprene rubbers; acrylonitrile rubbers; acrylonitrile-butadiene rubbers; styrene-ethylene block copolymers; maleic anhydride or succinate modified metallocene catalyzed ethylene copolymers; polypropylene resins; ionomer resins; polyamides; polyesters; polyesteresters; urethanes; polyureas; chlorinated polyethylenes; polysulfide rubbers; fluorocarbons; or a mixture thereof.

In one embodiment, the core comprises a center and at least one outer core layer. The center has a diameter of about 0.5 inches to about 1.6 inches. The outer core layer preferably uses a ZDA level higher than that of the center. Preferably, the outer core layer is formed from a thermoset material as set forth above. In forming the outer core layer, the selected material is heated to a temperature that makes the material more pliable, but not to its cure activation temperature. Then, after the center is inserted between the two hemispherical cups of the outer core layer, the material is heated to a second temperature that is greater than the cure activation temperature of the material, allowing the two shells to fuse together as they cure. Alternatively, for a thermoplastic material, the hemispherical cups are heated until they are pliable and then cooled. Thereafter, the center is inserted between the hemispherical cups and the assembly is heated to a second temperature above the melting temperature of the hemispherical cups, and thereafter cooled to solidify the thermoplastic material.

The materials used in forming either the golf ball center or any portion of the core, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder. Conventional mixing speeds for combining polymers are typically used. The mixing temperature depends upon the type of polymer components, and more importantly, on the type of free-radical initiator. Suitable mixing speeds and temperatures are well known to those of ordinary skill in the art, or may be readily determined without undue experimentation.

The mixture can be subjected to compression molding, injection molding, transfer molding, or a combination thereof to obtain solid spheres for the center or hemispherical shells for forming an intermediate layer. The temperature, pressure, and duration of the molding cycle are selected based upon reactivity of the mixture. The molding cycle may have a single step of molding the mixture at a single temperature for a fixed duration of time. The molding cycle may also include a two-step process, in which the polymer mixture is held in the mold at an initial temperature for an initial duration of time, followed by holding at a second, typically higher temperature for a second duration of time. Preferably a single-step cure cycle is employed. The curing process may in principle be carried out at sub-atmospheric pressure, at atmospheric pressure, or at super-atmospheric pressure. The pressure is usually set at about 1 to about 300 bars. Although the curing time depends on the various materials and temperature selected, the duration is usually from about 10 minutes to about 10 hours, preferably from about 20 minutes to about 3 hours. Partial cure may be carried out with preheating to facilitate full curing. Those of ordinary skill in the art will be readily able to adjust the curing time upward or downward based on the particular materials used and the discussion herein.

The crosslink density of the resulting core composition of the invention is significantly affected by the choice of the thermal initiator, the crosslinking agent, their respective concentrations, and the extent of control of the exothermic crosslinking reaction. The control of the maximum temperature during mixing and curing may be effected, for instance, by heat transfer via the mold through a water jacket or air-cooling. If the temperature is not controlled, the reaction can become autocatalytic, leading to temperature greater than 400° C., which would cause thermal decomposition and carbonization of the base polymer.

The C—C initiators described above may be used in any portion of the golf ball, including core layer(s), intermediate layer(s), cover layer(s), and coating layer(s). The core or core layer(s) of the present invention are preferably enclosed with one or more moisture barrier layers having a moisture vapor transmission rate ("MVTR") less than that of the cover, so that the underlying core layer(s) are protected from water vapor that passes through the cover. More preferably, the MVTR of the barrier layer is of less than about 0.95 $g \cdot mm/(m^2 \cdot day)$. The barrier layers are formed from materials that include, but are not limited to, poly-para-xylylene and its halogenated derivatives, ethylene vinyl alcohol copolymers, polyvinylidene chloride ("PVDC"), vermiculite, ionomer resins, aqueous dispersions of elastomer with exfoliated layered fillers, and non-aqueous dispersions of rubber material with metal flakes.

An optional intermediate layer may be disposed between the core and the cover, preferably between the cover and the optional barrier layer. The intermediate layer may be part of the cover as an inner cover layer, formed from non-ionomeric acid polymers or ionomeric derivatives thereof, polyamides, polyolefins, reactive liquid materials such as polyurethanes or polyureas (preferably castable), epoxies, polyethers, polyesters, polyetheresters such as Hytrel® from DuPont, polyetheramides such as Pebax® from AtoFina, nylons, metallocene-catalyzed polymers, styrenic block copolymers such as Kraton® from Shell Chemicals, acrylonitrile-butadiene-styrene copolymers ("ABS"), polyvinyl chlorides, polyvinyl alcohol copolymers, polycarbonates, polyesteramides, polyamides, polyimides, polyetherketones, polyamideimides, silicones, metal salts of fatty acids, and combinations thereof, such as blends of polycarbonate and acrylonitrile-butadiene-styrene, blends of polycarbonate and polyurethane. Two or more of these materials may be blended together to form the intermediate layer.

The intermediate layer may incorporate a modulus-enhancing filler or a density-modifying filler to attain preferred physical and mechanical properties. The composition of the intermediate layer may have a modulus of about 2,000 psi to about 150,000 psi, a material hardness of about 60 Shore C to about 80 Shore D, and a thickness of about 0.005 inches to about 0.6 inch. The composition of the intermediate layer may be applied as a liquid, powder, dispersion, lacquer, paste, gel, melt, or solid half shells. The intermediate layer may be formed around the core or onto the inside of the cover by sheet stock or vacuum shrink-wrapping, compression molding, injection molding, vacuum deposition, RIM, lamination, casting, spraying, dipping, powder coating, or any other deposition means. Preferably, a combination of these methods is used, such as injection/compression molding, RIM/compression molding, preform/compression molding, injection molding/grinding, injection/progressive compression molding, co-injection molding, or simplified casting of a single block material.

The covers of the present invention can be formed from any conventional materials used in golf ball covers, based on the desired performance characteristics. The cover may comprise one or more layers, such as an outer cover layer and one or more inner cover layer(s). Inner cover layer(s) may be wound layer(s) or hoop stress layer(s). Suitable thermoplastic or thermoset materials for the cover layers include non-ionomeric acid copolymers, such as ethylene (meth)acrylic acid copolymers and terpolymers having an acid content of about 2% to about 50%, under the trade names of Nucrel® from E. I. DuPont de Nemours & Company and Escor® from ExxonMobil; anionic and cationic ionomers, particularly the acid copolymers partially or fully neutralized with organic or inorganic cations by about 1% to about 100% or more, such as Surlyn® and Entira® from E. I. DuPont de Nemours & Company and Iotek® from ExxonMobil; thermoplastic or thermoset (vulcanized) synthetic or natural rubbers, such as polyolefins and copolymers or blends thereof, polystyrenes and copolymers thereof, and polymers produced with single-site catalysts such as metallocene; reactive liquid materials such as polyurethanes or polyureas (preferably castable); aliphatic or aromatic thermoplastics, such as polyesters (Hytrel® from E. I. DuPont de Nemours & Company and Lomod® from General Electric Company), polycarbonates, polyacetals; polyimides, polyetherketones, polyamideimides, block copolymers (Kraton® rubbers from Shell Chemical), and co-polyetheramides (Pebax® from AtoFina); vinyl resins such as polyvinyl alcohol copolymers and PVDC; polyamides such as poly(hexamethylene adipamide) and others prepared from diamines, fatty acids, dibasic acids, and amino acids; acrylic resins; synthetic or natural vulcanized rubber such as balata; and blends and alloys, such as blends of polycarbonate and acrylonitrile-butylene-styrene, blends of polycarbonate and polyurethane, and blends of polyvinyl chloride with acrylonitrile-butadiene-styrene or ethylene vinyl acetate.

Preferably, the golf ball cover comprises a polyurethane or polyurea composition having a reaction product formed from a polyahl, an isocyanate, and an optional curing agent. The polyahls are preferably incorporated into one or more soft segments of the reaction product. Suitable polyahls such as polyols and polyamines are organic, modified organic, saturated, aliphatic, alicyclic, unsaturated, araliphatic, aromatic, substituted, unsubstituted, or ionomeric, having two or more reactive hydrogen groups per molecule, such as primary or secondary hydroxy groups or amine groups. The isocyanate-reactive hydroxy and/or amine groups may be terminal or pendant groups on the oligomeric or polymeric backbone, and in the case of secondary amine groups, may even be embedded within the backbone.

Any isocyanate available to one of ordinary skill in the art is suitable for use according to the invention. The isocyanate may be organic, modified organic, saturated, aliphatic, alicyclic, unsaturated, araliphatic, aromatic, substituted, or unsubstituted diisocyanate or polyisocyanate monomers having two or more free reactive isocyanate ("NCO") groups; isomers thereof; modified derivatives thereof; dimers thereof; trimers thereof; or isocyanurates thereof. The isocyanate may also include any isocyanate-terminated multimeric adducts, oligomers, polymers, prepolymers, low-free-monomer prepolymers, quasi-prepolymers, and modified polyisocyanates derived from the isocyanates and polyisocyanates above. Low-free-monomer prepolymers refer to prepolymers having free isocyanate monomer levels less than about 0.5 weight percent. Curing agents are monomeric, oligomeric, or polymeric compounds used in cover compositions for chain-extension and/or crosslink. Suitable curing agents for the invention include polyahls and epoxies, preferably hydroxy curatives, amine curatives, and amino alcohol curatives having a molecular weight of about 50 to about 5,000.

For best light stability, all reactants in the polyurethane or polyurea compositions, including the polyahl(s), the isocyanate(s), and the curing agent(s) are substantially saturated. A hindered secondary diamine having a high level of stearic hindrance may be used to beneficially slow down the curing process. A variety of additives can optionally be incorporated into the cover layer compositions of the present invention in amounts sufficient to achieve their specific purposes and desired effects. Suitable additives include, but are not limited to, catalysts such as dibutyltin dilaurate, UV absorbers, hindered amine light stabilizers, antioxidants, accelerators, fillers, viscosity modifiers, release agents, plasticizers, compatibilizing agents, coupling agents, dispersing agents, colorants including pigments and dyes, optical brighteners, surfactants, lubricants, stabilizers, metals, processing aids or oils, blowing agents, freezing point depressants, and any other modifying agents known to one of ordinary skill in the art.

The cover layer preferably has a flexural modulus of at least about 2,000 psi, a material hardness between about 20 Shore D and about 75 Shore D, and a hardness as measured on the ball of less than about 80 Shore D. In one embodiment, the cover layer has a Shore D hardness of about 30 to about 60 and a flexural modulus of about 10,000 psi to about 80,000 psi. A thin cover layer with a thickness of about 0.01 inches to about 0.04 inches is preferred for players with high swing speeds, while a relatively thick cover layer of greater than 0.04 inches to about 0.08 inch, more preferably about 0.05 inches to about 0.07 inches, is preferred for players with moderate swing speeds. In a preferred embodiment, the overall cover thickness is about 0.01 inches to about 0.07 inches.

Any method known to one of ordinary skill in the art may be used to produce the cover layer of the present invention. One-shot methods involving concurrent mixing of the isocyanate, the polyether polyahl, and the curing agent are feasible. The prepolymer method described above is preferred, however, because it affords a more homogeneous mixture resulting in a more consistent polymer composition. The prepolymer may be reacted with a diol or a secondary diamine to form a thermoplastic material, or reacted with a triol, tetraol, primary diamine, triamine, or tetramine to form a thermoset material. Other methods suitable for forming the layers include casting, compression molding, reaction injection molding ("RIM"), liquid injection molding ("LIM"), injection-compression molding, pre-reacting the components to form an injection moldable thermoplastic material and then injection molding, and combinations thereof, such as RIM/compression molding, injection/compression molding, progressive compression molding, and the like. Thermoplastic formulations may be processed using any number of compression or injection molding techniques. Thermoset formulations may be castable, reaction injection moldable, sprayable, or applied in a laminate form or by any techniques known in the art. Castable reactive liquid materials such as polyurea, polyurethane, and polyurethane/polyurea hybrid can provide very thin layers such as outer cover layers that are desirable on golf balls. Other techniques include spraying, dipping, spin coating, or flow coating.

The golf ball of the present invention as described above preferably has a COR of greater than about 0.79, a compression of less than about 110, and a moment of inertia of less than about 84 g·cm$^2$. The golf ball can have any diameter, preferably from about 1.68 inches to about 1.76 inches, and most preferably about 1.68 inches. At least 60% of the outermost surface of the golf ball is covered by about 250 to about 450 dimples of equal or different shape and size. Preferred dimple patterns involving catenary curves, and preferred lift and drag characteristics of the golf ball are disclosed in co-pending U.S. Application Publication Nos. 2003/0114255 and 2003/0045378, respectively, both incorporated herein by reference in their entirety.

The present invention is further illustrated by the following non-limiting examples. Sample cores ("SC") 1–4 and 5–8 were compression molded. Their compositions and properties such as compression and COR at 125 ft/s are presented in Tables I and II below. Amounts of the materials used are expressed in phr.

TABLE I

| | SC 1 | SC 2 | SC 3 | SC 4 |
|---|---|---|---|---|
| Composition | | | | |
| Buna ® CB-23 | 100 | 100 | 100 | 100 |
| ZDA | 24 | 24 | 24 | 24 |
| Zinc Oxide | 5 | 5 | 5 | 5 |
| ZnPCTP | 0 | 0 | 0.5 | 0.5 |
| Perkadox ® BC | 0.45 | 0.45 | 0.45 | 0.45 |
| Perkadox ® 30 | 0 | 0.5 | 0 | 0.5 |
| Property | | | | |
| Compression | 33.3 | 37.7 | 12.3 | 21.4 |
| COR @ 125 ft/s | 0.7959 | 0.7984 | 0.7976 | 0.8040 |

TABLE II

| | SC 5 | SC 6 | SC 7 | SC 8 |
|---|---|---|---|---|
| Composition | | | | |
| Buna ® CB-23 | 100 | 100 | 100 | 100 |
| ZDA | 28 | 28 | 28 | 28 |
| Zinc Oxide | 5 | 5 | 5 | 5 |
| ZnPCTP | 0 | 0 | 0.5 | 0.5 |
| Perkadox ® BC | 0.45 | 0.45 | 0.45 | 0.45 |
| Perkadox ® 30 | 0 | 0.5 | 0 | 0.5 |
| Property | | | | |
| Compression | 55.8 | 58.4 | 40.2 | 49.5 |
| COR @ 125 ft/s | 0.8053 | 0.8078 | 0.8114 | 0.8183 |

SC 1–4, with a ZDA level of 24 phr, all exhibit a compression of less than 40 and a COR at 125 ft/s of greater than about 0.79. With a ZDA level of 28 phr, SC 5–8 all exhibit a compression of 40 to 60 and a COR at 125 ft/s of greater than about 0.8. The incorporation of halogenated thiophenol ZnPCTP is capable of substantially decreasing the core compression. In comparison, the incorporation of C—C initiator Perkadox® 30 is capable of substantially increasing the core compression, by at least about 5%, preferably by greater than about 10%. The compression boosting effect of the C—C initiator is more prominent in core compositions having a halogenated thiophenol, where the core compression is increased by at least about 20%, preferably by greater than about 50%. Concomitantly, the C—C initiator is able to enhance the core COR at 125 ft/s by itself, and in combination with the halogenated thiophenol, by at least about 0.001, preferably by greater than about 0.005. The data of Tables I and II demonstrate that the C—C initiator can be used with or without a halogenated thiophenol to achieve any desirable core compression, while the combination of the two synergistically and advantageously increase the core COR.

All patents and patent applications cited in the foregoing text are expressly incorporated herein by reference in their entirety.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball comprising a core and a cover, wherein at least one of the core or the cover comprises an elastomeric composition comprising a base polymer, a salt of unsaturated acid having 3 to 8 carbon atoms, and a carbon-carbon initiator that is free of peroxide groups and capable of thermally decomposing into carbon-based free radicals by breaking at least one elongated carbon-carbon single bond.

2. The golf ball of claim 1, wherein the carbon-carbon initiator having a formula of:

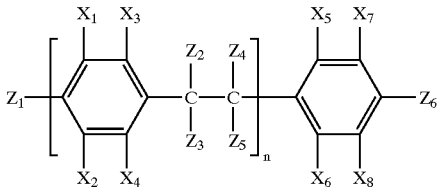

where n is an integer from 1 to about 10, $X_1$ to $X_8$ are independently selected from hydrogen, halogen, linear or branched alkyl, alkoxy, cyano, nitro, nitrile, hydroxyl, or amino groups, and $Z_1$ to $Z_6$ are independently selected from hydrogen, halogen, linear or branched alkyl, alkoxy, aryl, aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups;

or a formula of:

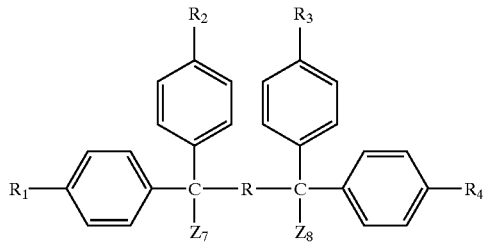

where R is a substituted hydrocarbon moiety, $R_1$ to $R_4$ are independently selected from hydrogen, alkyl, or alkoxy groups, and $Z_7$ and $Z_8$ are independently selected from hydrogen, halogen, linear or branched alkyl, alkoxy, aryl, aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups.

3. The golf ball of claim 2, wherein the base polymer comprises trans-polyisoprene, gutta-percha, natural or synthetic rubbers, polybutadienes, polyisoprenes, ethylene-propylene rubbers, styrene-butadiene rubbers, styrene-propylene-diene rubbers, chloroprene rubbers, acrylonitrile rubbers, acrylonitrile-butadiene rubbers, polysulfide rubbers, rubbers synthesized using metallocene catalysts or single-site catalysts, ethylene-propylene-diene terpolymers, styrene-ethylene block copolymers, maleic anhydride or succinate modified metallocene catalyzed ethylene copolymers, polypropylene resins, chlorinated polyethylenes, ionomer resins, polyamides, polyethers, polyesters, polyurethanes, polyureas, polyimides, polysiloxanes, silicones, epoxies, or fluorocarbons.

4. The golf ball of claim 2, wherein the carbon-carbon initiator is present in an amount of about 0.01 phr to about 100 phr by weight of the base polymer.

5. The golf ball of claim 2, wherein the elastomeric composition further comprises at least one of a peroxide initiator, a crosslinking agent, a halogenated thiophenol, or an accelerator.

6. The golf ball of claim 1, wherein the carbon-carbon initiator has at least one elongated carbon-carbon single bond of greater than 0.155 nm.

7. The golf ball of claim 1, wherein the carbon-carbon initiator has a decomposition temperature of about 150° C. to about 300° C. at a half-life of about 10 hours to about 0.1 hours.

8. The golf ball of claim 1, wherein the carbon-carbon initiator comprises aliphatic hydrocarbon initiators, alicyclic hydrocarbon initiators, aromatic hydrocarbon initiators, substituted carbon-carbon initiators, or oligomeric carbon-carbon initiators.

9. The golf ball of claim 8, wherein the carbon-carbon initiator comprises bibenzyl; α,α'-dimethoxybibenzyl; α,α'-dimethoxy-α,α'-dimethylbibenzyl; α-methoxy-α,α'-diphenylbibenzyl; α,α'-dimethoxy-α,α'-diphenylbibenzyl; 1,2-dinitro-1,2-diphenylethane; 1,2-dinitro-1,2-di(p-tolyl) ethane; 1,2-dichloro-1,2-diphenylethane; 1,2-dibromo-1,2-diphenylethane; 1,2-dibromo-1,2-dimethyl-1,2-diphenylethane; tetraphenylethane; hexaphenylethane; tetrabromodiphenylethane; pentabromodiphenylethane; hexabromodiphenylethane; heptabromodiphenylethane; octabromodiphenylethane; novabromodiphenylethane; decabromodiphenylethane; 1,2-bis(trimethylsiloxy)-1,2-diphenylethane; 1,2-diphenyl-1,2-ethanediol (i.e.; hydrobenzoin); 1,1,2,2-tetraphenyl-1,2-ethanediol (i.e.; benzopinacol or tetraphenylethylene glycol); 2,3-dimethyl-2,3-butanediol (i.e.; pinacol; pinacone; or tetramethylethylene glycol); 2,3-diphenyl-2,3-butanediol; 3,4-diphenyl-3,4-hexanediol; 1,2-bis(trimethylsiloxy)-1,1,2,2-tetraphenylethane; 2,3-bis(trimethylsilyloxy)-2,3-diphenylbutane; 2,3-bis(trimethylsilyloxy)-2,2,3,3-tetraphenylbutane; 2,3-diethyl-2,3-diphenylsuccinonitrile (i.e.; diethyl-2,3-dicyano-2,3-diphenylsuccinate); 2,2,3,3-tetraphenylsuccinonitrile; 2,3-dimethylbutane; 2,3-diphenylbutane; 2-methyl-2,3-diphenylbutane; 2,3-dimethyl-1,1-diphenylbutane; 2,3-dimethyl-1,2-diphenylbutane; 2,3-dimethyl-1,4-diphenylbutane; 2,3-dimethyl-2,3-diphenylbutane; 2,3-diethyl-2,3-diphenylbutane; 2-methyl-3-ethyl-2,3-diphenylbutane; 2,3-dipropyl-2,3-diphenylbutane; 2,3-dibutyl-2,3-diphenylbutane; 2,3-diisobutyl-2,3-diphenylbutane; 2,3-dihexyl-2,3-diphenylbutane; 2-methyl-2-phenyl-3-tolylbutane; 2-methyl-3-phenyl-2-tolylbutane; 2-benzyl-3-methyl-1-phenylbutane; 2,2,3,3-tetraphenylbutane; 2,3-dimethyl-2,3-di(p-methylphenyl)butane; 2,3-diethyl-2,3-di (p-methylphenyl)butane; 2,3-dimethyl-2,3-di(p-tolyl) butane; 2,3-dimethyl-2,3-di[p-(t-butyl)phenyl]butane; 1,4-bis(1-bora-3,4-diphenylcyclopentyl)-2,3-diphenylbutane; 2,3-dimethyl-2-methylphenyl-3-[(p-2',3'-dimethyl-3'-methylphenyl-butyl)phenyl]butane; 2,3-dimethyl-2,3-di(p-isopropylphenyl)butane; 2,3-dimethyl-2,3-di(p-benzylphenyl)butane; 2,3-dimethyl-2,3-di(2,3,4,5,6-pentamethylphenyl)butane; 2,3-dimethyl-2,3-di(m-hexadecylphenyl)butane; 2,3-dimethyl-2,3-di(p-eicosylphenyl)butane; 2-methyl-3-isopropyl-2,3-di(p-isobutylphenyl)butane; 2,3-dicyano-2,3-diphenylbutane; 2,3-dimethyl-2,3-di(p-methoxyphenyl)butane; 2,3-dimethyl-2,3-di(p-ethoxyphenyl)butane; 2,3-dimethyl-2,3-di(p-chlorophenyl)butane; 2,3-dimethyl-2,3-di(p-bromophenyl)butane; 2,3-dimethyl-2,3-di(p-iodophenyl) butane; 2,3-dimethyl-2,3-di(p-nitrophenyl)butane; 2,3-diethyl-2,3-di(p-chlorophenyl)butane; 2,3-diethyl-2,3-di(p-bromophenyl)butane; 2,3-diethyl-2,3-di(p-iodophenyl) butane; 2,3-diethyl-2,3-di(p-nitrophenyl)butane; 2-methyl-1,1-diphenylpentane; 4-methyl-1,1-diphenylpentane; 2-methyl-1,2-diphenylpentane; 4-methyl-1,2-diphenylpentane; 2-methyl-1,3-diphenylpentane; 4-methyl-1,3-diphenylpentane; 2-methyl-1,4-diphenylpentane; 2-methyl-1,5-diphenylpentane; 4-methyl-2,2-diphenylpentane; 2-methyl-2,3-diphenylpentane; 2-methyl-2,4-diphenylpentane; 2-methyl-3,4-diphenylpentane; 2-methyl-2,5-diphenylpentane; 2-methyl-3,3-diphenylpentane; 3,4-dimethylhexane; 3,4-dimethyl-3,4-diethylhexane; 1,1-diphenylhexane; 1,2-diphenylhexane (i.e.; 2-benzyl-1-phenylpentane); 1,3-diphenylhexane; 1,4-diphenylhexane; 1,5-diphenylhexane; 1,6-diphenylhexane; 2,2-diphenylhexane; 2,3-diphenylhexane; 2,4-diphenylhexane; 2,5-diphenylhexane; 3,3-diphenylhexane; 3,4-diphenylhexane; 2,3-dimethyl-2,3-diphenylhexane; 3,4-dimethyl-3,4-diphenylhexane; 3,4-diethyl-3,4-diphenylhexane; 3,4-dipropyl-3,4-diphenylhexane; 3,4-diisobutyl-3,4-diphenylhexane; 3,3,4,4-tetraphenylhexane; 3,4-diethyl-3,4-di(3,4,5-triethylphenyl)hexane; 4,5-dimethyl-4,5-diphenyloctane; 4,5-dipropyl-4,5-diphenyloctane; 5,6-dimethyl-5,6-diphenyldecane; 5,6-dimethyl-5,6-di(p-cyclohexylphenyl)decane; 6,7-dimethyl-6,7-diphenyldodecane; 7,8-dimethyl-7,8-di(p-methoxyphenyl)tetradecane; 1,1'-diphenyl-1,1'-bicyclopentyl; 1,1'-diphenyl-1,1'-bicyclohexyl; poly(1,4-diisopropylbenzene); or poly(1,3-diisopropylbenzene).

10. The golf ball of claim 1, wherein the carbon-carbon initiator is present in an amount of about 0.1 phr to about 10 phr by weight of the base polymer.

11. The golf ball of claim 1, wherein the carbon-carbon initiator is present in an amount of about 0.5 phr to about 5 phr by weight of the base polymer.

12. The golf ball of claim 1, wherein the base polymer comprises at least one polybutadiene having a Mooney viscosity of about 20 to about 150.

13. The golf ball of claim 1, wherein the composition is substantially free of peroxide initiators, and sulfur-based curing agents.

14. The golf ball of claim 1, wherein a weight ratio of the carbon-carbon initiator to the salt is about 0.01:1 to about 5:1.

15. The golf ball of claim 1, wherein the composition further comprises a peroxide initiator.

16. The golf ball of claim 15, wherein a weight ratio of the carbon-carbon initiator to the peroxide initiator is about 0.05:1 to about 50:1.

17. The golf ball of claim 15, wherein the peroxide initiator has a decomposition temperature lower than that of the carbon-carbon initiator.

18. The golf ball of claim 1, wherein the composition further comprises a halogenated thiophenol.

19. The golf ball of claim 1, wherein the core comprises a center and at least one outer core layer.

20. The golf ball of claim 1, wherein the golf ball comprises at least one intermediate layer disposed between the core and the cover.

21. The golf ball of claim 1, wherein the cover comprises an outer cover layer and an inner cover layer, and at least one of the cover layers comprises a thermoplastic or thermoset polyurethane or polyurea.

22. The golf ball of claim 1, wherein the carbon-carbon initiator is present in the core in an amount sufficient to increase a compression of the core by at least about 5%.

23. The golf ball of claim 22, wherein the core has a coefficient of restitution, and the amount of the carbon-carbon initiator is sufficient to increase the coefficient of restitution by at least about 0.001.

24. The golf ball of claim 22, wherein the carbon-carbon initiator comprises 2,3-dimethyl-2,3-diphenylbutane, 3,4-dimethyl-3,4-diphenylhexane, or poly(1,4-diisopropylbenzene).

25. The golf ball of claim 22, wherein the composition further comprises a halogenated thiophenol.

26. The golf ball of claim 25, wherein the carbon-carbon initiator is present in an amount sufficient to increase the core compression by at least about 20%.

27. The golf ball of claim 22, wherein the composition further comprises at least one of a peroxide initiator, an accelerator, a free radical scavanger, a scorch retarder, a stable free radical, a filler, an antioxidant, or a processing aid or oil.

28. A golf ball of claim 1, wherein the core has a diameter of about 1.55 inches to about 1.65 inches; and the cover has an overall thickness of about 0.01 inches to about 0.07 inches, the cover comprising a thermoplastic or thermoset polyurethane or polyurea.

29. The golf ball of claim 28, wherein the core comprises a center and an outer core layer, and the carbon-carbon initiator is present in the center, the outer core layer, or both.

30. The golf ball of claim 28, wherein the cover further comprising an inner cover layer and an outer cover layer, the inner cover layer comprising a thermoplastic material, and the outer cover layer is softer than the inner cover layer.

31. A golf ball comprising a core and a cover, wherein at least one of the core or the cover comprises an elastomeric composition comprising a base polymer, a peroxide initiator, and a carbon-carbon initiator that is free of peroxide groups and capable of thermally decomposing into carbon-based free radicals by breaking at least one elongated carbon-carbon single bond.

32. A golf ball comprising a core and a cover, wherein at least the core or the cover comprises an elastomeric composition comprising a base polymer and a carbon-carbon initiator having a formula of:

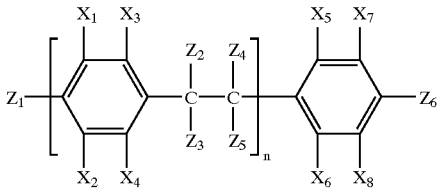

where n is an integer from 1 to about 10, $X_1$ to $X_8$ are independently selected from hydrogen, halogen, linear or branched alkyl, alkoxy, cyano, nitro, nitrile, hydroxyl, or amino groups, $Z_2$ is selected from hydrogen, halogen, branched alkyl, alkoxy, aryl, aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups, and $Z_1$ and $Z_3$ to $Z_6$ are independently selected from hydrogen, halogen, linear or branched alkyl, alkoxy, aryl, aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups;

or a formula of:

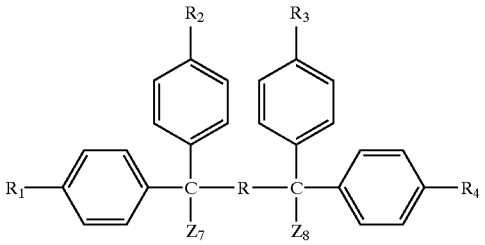

where R is a substituted hydrocarbon moiety, $R_1$ to $R_4$ are independently selected from hydrogen, alkyl, or alkoxy groups, and $Z_7$ and $Z_8$ are independently selected from hydrogen, halogen, linear or branched alkyl, alkoxy, aryl, aryloxy, cycloalkyl, substituted cycloalkyl, vinyl, substituted phenyl, cyano, nitro, nitrile, hydroxyl, amino, carboxyl, ester, amide, thio, epoxide, silyl, or silyloxy groups.

33. A golf ball comprising a core and a cover, wherein at least one of the core or the cover comprises an elastomeric composition comprising a base polymer and a carbon-carbon initiator that is free of peroxide groups and capable of thermally decomposing into carbon-based free radicals by breaking at least one elongated carbon-carbon single bond, the carbon-carbon initiator is selected from the group consisting of aliphatic hydrocarbon initiators, alicyclic hydrocarbon initiators, bibenzyl; α,α'-dimethoxybibenzyl; α,α'-dimethoxy-α,α'-dimethylbibenzyl; α-methoxy-α,α'-diphenylbibenzyl; α,α'-dimethoxy-α,α'-diphenylbibenzyl; 1,2-dinitro-1,2-diphenylethane; 1,2-dinitro-1,2-di(p-tolyl) ethane; 1,2-dichloro-1,2-diphenylethane; 1,2-dibromo-1,2-diphenylethane; 1,2-dibromo-1,2-dimethyl-1,2-diphenylethane; tetraphenylethane; hexaphenylethane; tetrabromodiphenylethane; pentabromodiphenylethane; hexabromodiphenylethane; heptabromodiphenylethane; octabromodiphenylethane; novabromodiphenylethane; decabromodiphenylethane; 1,2-bis(trimethylsiloxy)-1,2-diphenylethane; 1,2-diphenyl-1,2-ethanediol (i.e.; hydrobenzoin); 1,1,2,2-tetraphenyl-1,2-ethanediol (i.e.; benzopinacol or tetraphenylethylene glycol); 2,3-dimethyl-2,3-butanediol (i.e.; pinacol; pinacone; or tetramethylethylene glycol); 2,3-diphenyl-2,3-butanediol; 3,4-diphenyl-3,4-hexanediol; 1,2-bis(trimethylsiloxy)-1,1,2,2-tetraphenylethane; 2,3-bis(trimethylsilyloxy)-2,3-diphenylbutane; 2,3-bis(trimethylsilyloxy)-2,2,3,3-tetraphenylbutane; 2,3-diethyl-2,3-diphenylsuccinonitrile (i.e.; diethy-2,3-dicyano-2,3-diphenylsuccinate); 2,2,3,3-tetraphenylsuccinonitrile; 2,3-dimethylbutane; 2,3-diphenylbutane; 2-methyl-2,3-diphenylbutane; 2,3-dimethyl-1,1-diphenylbutane; 2,3-dimethyl-1,2-diphenylbutane; 2,3-dimethyl-1,4-diphenylbutane, 2,3-dibutyl-2,3-diphenylbutane; 2,3-diisobutyl-2,3-diphenylbutane; 2,3-dihexyl-2,3-diphenylbutane; 2-methyl-2-phenyl-3-tolylbutane; 2-methyl-3-phenyl-2-tolylbutane; 2-benzyl-3-methyl-1-phenylbutane; 2,2,3,3-tetraphenylbutane; 2,3-dimethyl-2,3-di[(t-butyl)phenyl]butane; 1,4-bis(1-bora-3,4-diphenylcyclopentyl)-2,3-diphenylbutane; 2,3-dimethyl-2-methylphenyl-3-[(p-2,3'-dimethyl-3'-methylphenyl-butyl)phenyl]butane; 2,3-dimethyl-2,3-di(p-benzylphenyl)butane; 2,3-dimethyl-2,3-di(2,3,4,5,6-pentamethylphenyl)butane; 2,3-dimethyl-2,3-di(m-hexadecylphenyl)butane; 2,3-dimethyl-2,3-di(p-eicosylphenyl)butane; 2,3-dicyano-2,3-diphenylbutane; 2,3-dimethyl-2,3-di(p-methoxyphenyl)butane; 2,3-dimethyl-2,3-di(p-ethoxyphenyl)butane; 2,3-dimethyl-2,3-di(p-nitrophenyl)butane; 2,3-diethyl-2,3-di(p-nitrophenyl)butane; 2-methyl-1,1-diphenylpentane; 4-methyl-1,1-diphenylpentane; 2-methyl-1,2-diphenylpentane; 4-methyl-1,2-diphenylpentane; 2-methyl-1,3-diphenylpentane; 4-methyl-1,3-diphenylpentane; 2-methyl-1,4-diphenylpentane; 2-methyl-1,5-diphenylpentane; 4-methyl-2,2-diphenylpentane; 2-methyl-2,3-diphenylpentane; 2-methyl-2,4-diphenylpentane; 2-methyl-3,4-diphenylpentane; 2-methyl-2,5-diphenylpentane; 2-methyl-3,3-diphenylpentane; 3,4-dimethylhexane; 3,4-dimethyl-3,4-diethylhexane; 1,1-diphenylhexane; 1,2-diphenylhexane (i.e.; 2-benzyl-1-phenylpentane); 1,3-diphenylhexane; 1,4-diphenylhexane; 1,5-diphenylhexane; 1,6-diphenylhexane; 2,2-diphenylhexane; 2,3-diphenylhexane; 2,4-diphenylhexane; 2,5-diphenylhexane; 3,3-diphenylhexane; 3,4-diphenylhexane; 3,4-diisobutyl-3,4-diphenylhexane; 3,3,4,4-tetraphenylhexane; 3,4-diethyl-3,4-di(3,4,5-triethylphenyl)hexane; 5,6-dimethyl-5,6-diphenyldecane; 5,6-dimethyl-5,6-di(p-cyclohexylphenyl)decane; 6,7-dimethyl-6,7-diphenyldodecane; 7,8-dimethyl-7,8-di(p-methoxyphenyl)tetradecane; 1,1'-diphenyl-1,1'-bicyclopentyl; 1,1'-diphenyl-1,1'-bicyclohexyl; poly(1,4-diisopropylbenzene); and poly(1,3-diisopropylbenzene).

* * * * *